United States Patent [19]

Widdershoven

[11] 4,223,641

[45] Sep. 23, 1980

[54] GAS BOILER CONTROL

[75] Inventor: Louis H. Widdershoven, Kerkrade-West, Netherlands

[73] Assignee: Raypak Produkten B.V., Kerkrade-West, Netherlands

[21] Appl. No.: 922,729

[22] Filed: Jul. 7, 1978

[30] Foreign Application Priority Data

Jul. 11, 1977 [NL] Netherlands ..... 7707693

[51] Int. Cl.[2] ..... F22B 37/42

[52] U.S. Cl. ..... 122/448 R; 126/351; 431/90; 431/180

[58] Field of Search ..... 126/85 R, 116 A, 351; 431/180, 12, 90; 122/448, 451

[56] References Cited

U.S. PATENT DOCUMENTS

| | | | |
|---|---|---|---|
| 1,935,237 | 11/1933 | Bryant | 431/12 X |
| 2,131,221 | 9/1938 | Crary | 431/180 |
| 2,848,042 | 8/1958 | Wright | 431/180 |
| 3,486,434 | 12/1969 | Frey et al. | 431/12 |
| 3,623,458 | 11/1971 | Block | 126/85 |

*Primary Examiner*—Edward G. Favors

*Attorney, Agent, or Firm*—Browdy and Neimark

[57] ABSTRACT

A gas-fired boiler installation with control of the supply of combustion components, provided with a combustion space that upwardly is in communication with a boiler flue and at the bottom side is confined by a burner bed with atmospheric burners having interposed venturi tubes which upon throughflow by the gas controllably supplied via a valve, draw in primary air. Between the elements of the burner bed, from the bottom side thereof, secondary air can be drawn into the combustion space while the secondary air is controllable in conjunction with the control of the gas supply by a control valve.

8 Claims, 3 Drawing Figures

GAS BOILER CONTROL

Figure 1:
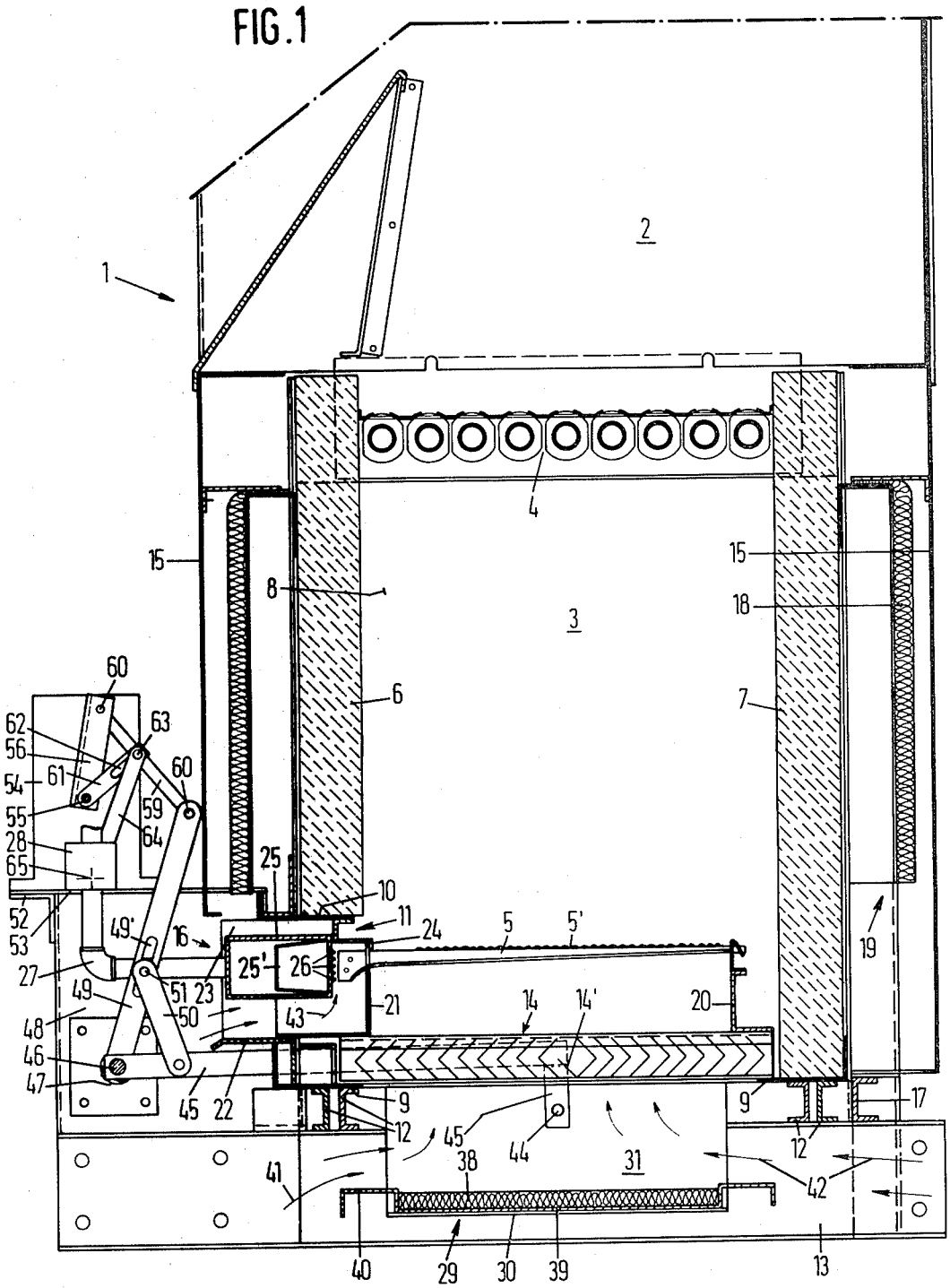

The present invention relates to a gas fired boiler installation with control of the supply of combustion components, provided with a combustion space which upwardly is in communication with a boiler flue and at the bottom side is confined by a burner bed having atmospheric burners with interposed venturi tubes which upon throughflow by the gas controllably supplied via a valve, effect primary air suction, whereby between the elements of the burner bed from the bottom side thereof, secondary air can be drawn into the combustion space, as already applied earlier by applicants.

In this application there is provided a modulating control of the supplied gas quantity, so that the installation can be operated at full, minimal and all intermediate capacities.

It is the object of the present invention to increase the output of such an installation.

The described installation, in the embodiment according to the invention, is provided with a control valve adapted for controlling the supply of the secondary air in conjunction with the control of the gas supply. It is thus avoided that an excess of air, upon loads smaller than those at maximal capacity of the installation, causes a diminished output, which was especially the case at high load and during shutdown of the installation by the secondary air ineffectively rising through the furnace and the boiler flue and producing cooling.

The invention also provides effective embodiments of the control.

Figure 2:
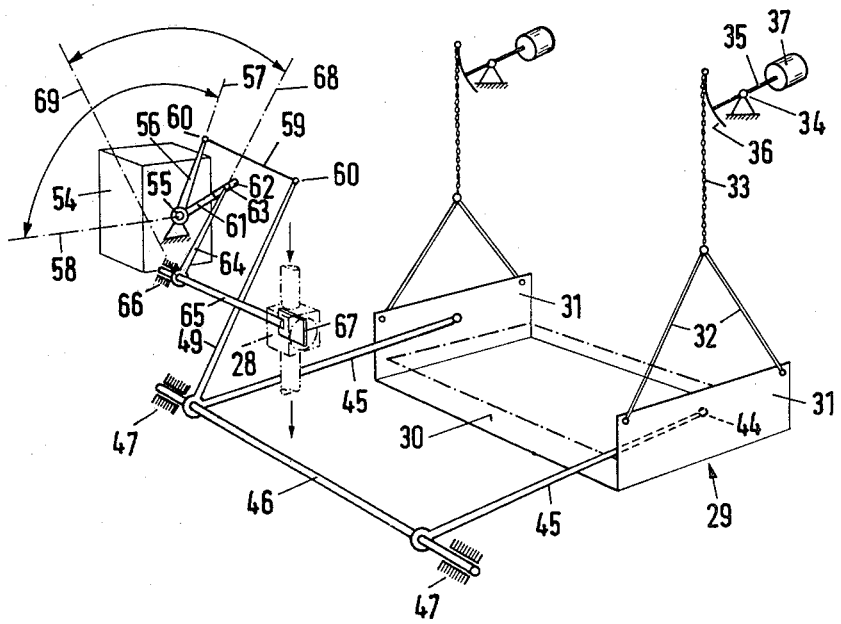
Figure 3:
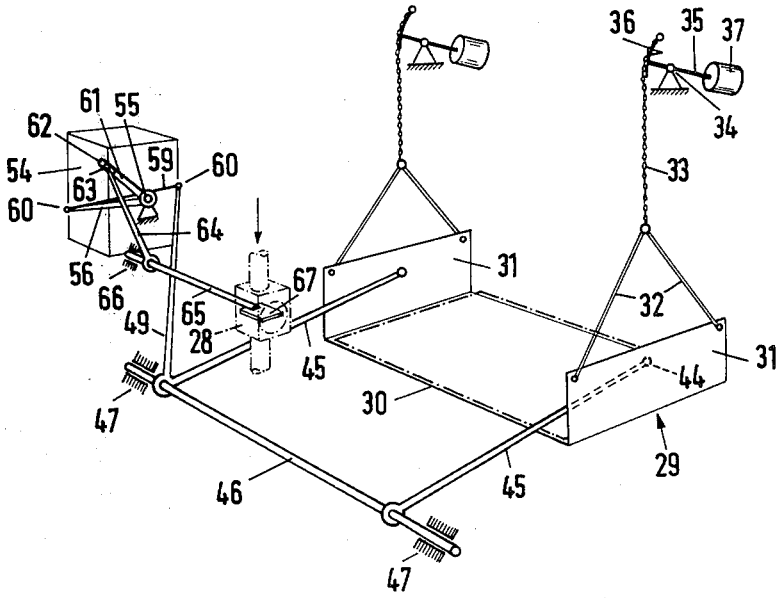

The invention will now be explained by description, with reference to the accompanying drawings, of principles of a bolier installation which is designed in accordance with the invention, and wherein further particulars will be shown. The drawing shows in FIG. 1 a vertical cross-section of substantially the lower part of a boiler installation wherein the invention is applied;

FIG. 2 is a perspective, diagrammatic view of the control apparatus for controlling the admission of the combustion components; and FIG. 3 shows the apparatus according to FIG. 2 in a different control position.

In the boiler installation partly shown in FIG. 1 and indicated in general by 1, there is disposed a draught interruptor 2, under which is positioned the combustion space or furnace 3, which relative to the boiler flue is delimited by a bed of heat exchanging ribbed tubes 4 and at the bottom side is confined by a burner bed formed by a plurality of burner bars 5, each provided with a series of burner ports 5'.

The combustion space 3 is confined by vertical walls of refractory material, of which the two walls shown in cross-section and indicated respectively by 6 and 7 are contiguous to two walls 8 positioned parallel to the plane of drawing.

The side wall 7 and the two side walls 8 rest with their bottom end in a rectangular frame formed by L-profile beams 9, whose lower flanges extend towards each other, slightly beyond the inner side of said side walls. The side wall 6 terminates with its bottom end precisely at a level higher than that of the burner bed 5, 5' and is supported by an L-profile beam 10 which at its ends is connected through vertical beams, not shown in FIG. 1, to the frame formed by beams 9. As a result there is formed between the beam 10 and the subjacent beam 9 an opening 11 through which the burner bed with associated parts can be mounted.

The frame formed by beams 9 is carried by sections 12 situated underneath the side walls 6 and 7 normal to the plane of drawing, which sections are positioned with their ends on two bottom beams 13 parallel to the plane of drawing, said beams lying outwardly spaced apart from the side walls 8 on an assembly bottom.

On the lower flanges of the beams 9 rests an air supply grid 14 which is composed of chevron laminations 14'.

The side walls 6, 7 and 8 are spatially surrounded by a sheet iron casing indicated in its entirety by 15, which opposite the opening 11 leaves a corresponding opening 16 clear. The casing 15, not described in detail, also rests on the bottom beams 13 through supporting beams 17.

Between the casing 15 and the side walls 6, 7 and 8 there is disposed a layer 18 of insulating material, carried and laterally supported by a sheet and section construction not further described and indicated as a whole by 19.

The bars 5 of the burner bed are carried by sections 20 and 21, adjoining against the upper face of the grid formed by the chevron laminations 14. The beam 21, at its bottom, adjoins a section 22 contiguous to one of the beams 9. To the ends of the beam 22 there are welded plate sections 23 in such a way that the assembly 22, 23 bounds the bottom side and the vertical sides of opening 11. To the vertical flange of the beam 21 there is again a contiguous section 24 which fits against the bottom of the beam 10. The assembly 21, 24 shuts off the opening 11, so that in the burner space 3 only air can be drawn in as secondary air via the laminated grid 14 and as primary air through the burner bars 5 and burner ports 5', when the combustion gas is injected in the front of the bars 5.

Between the sheet sections 23 there extends a gas supply 25 having a control baffle 25' from which the gas can be injected into the bars 5 through gas nozzles 26. The gas duct 25 receives the gas via pipe 27 wherein a control valve 28 is incorporated.

Underneath air grid 14 there is disposed a control valve indicated in its entirety by 29, of which a horizontal sheet portion 30 extends underneath and beyond the side walls 8 such that the bent side plates 31 of the sheet portion 30 extend in the space between the plating of the casing 15 situated opposite the side walls 8 and the correspondingly positioned portion of the insulating layer 18. The valve 29 is suspended at the upper angular points of the side plates 31, see FIGS. 2 and 3, by means of a chain 32, which itself is suspended in the central portion from a chain 33 which is attached to a lever 35 pivotally mounted at 34 via a winding and unwinding strip 36 curved about the pivot bearing 34. On the levers 35 there is mounted a counterweight 37 so that the chains 32, 33 are always under tensile force, thereby imparting parallel guidance to the valve 29. The plate section 30 of the valve 29 is coated with an insulating layer 38 applied on an auxiliary plate 39 between the sections 40, which are formed at two opposite sides of the auxiliary plate 39.

In FIG. 1 valve 29 is drawn in its lowermost position, whereby the secondary air according to arrows 41 and 42 has complete access to the air grid 14, which air can mix beyond the burner bed 5, 5' with the mixture of gas and primary air emerging from the burner ports 5' which is drawn in along the route indicated by arrow 43 by the venturi effect in the bars 5. In the highest position of the valve 29, it substantially adjoins with the sections 40 the lower flanges of the beams 9, so that only the required minimum of secondary air is admitted to the grid 14.

For controlling the height position of the valve 29 this is connected through pivot pins 44 to two levers 45, which are non-rotatably secured on the shaft 46. The shaft 46 is mounted in bearing blocks 47 which are attached against structural plates 48 which themselves are secured on the ground beams 13. The shaft 46 can be rotated by means of lever 49 which is also mounted on the shaft 46 and, by the rod 50 in a specific angular position relative to one of the levers 45, is fixedly connected thereto. Since the lever 49 comprises a slot 49' for the fixing bolt 51, said angular position can be adjusted. This adjustability is not shown in the diagrammatic FIGS. 2 and 3.

On auxiliary construction 52, 53 connected for instance by welding to one of the structural plates 48 and a plate of the casing 15, there is mounted a motor housing 54 comprising a variable-speed motor, the energization of which is controlled by a regulator which is disposed in the space to be heated by the boiler installation 1 or is responsive elsewhere to the temperature of the water to be heated. The motor in the motor housing 54 is adapted for driving via a reduction gearing the outwardly extending shaft 55 in two rotation directions. On the shaft 55 there is secured a lever 56 which can be swivelled by the shaft 55 between the final positions shown by the dash-dot lines 57 and 58, which final positions are defined by terminal contacts in the motor housing 54.

The lever 49 is connected to the lever 56 by means of a rod 59 and shaft journals 60 so that the swivelling of the lever 56 between the final positions 57 and and 58 produces an up and down movement of the valve 29 between the entirely open control position and the closed control position.

To the shaft 55 there is also affixed lever 61 comprising a slot 62 wherein a pivot pin 63 of a lever 64 slidably engages and thereby coupling the levers 61 and 64. The lever 64 is fixedly but adjustably disposed on a shaft 65 which at 66 is mounted in a bearing block on the auxiliary construction 52, 53 at one end, and with its other end in the control valve 28 wherein the shaft 65 is coupled to the valve 67. Through the coupling of the levers 61 and 64, the shaft 65 is rotatable between angular final positions which are shown in FIG. 2 by means of dash-dot lines 68, 69 respectively. The valve 67, at the angular position corresponding to the shaft position 68, is in the open control position and at the angular position corresponding to the shaft position 69, in the closure position wherein yet a specific minimal gas quantity, e.g. 20% of the maximal quantity, is passed.

FIG. 2 shows the control means in the position corresponding to the completely open positions, or the final positions 57 and 58, and FIG. 3 in the other final positions.

As a result of the above described coupling, the maximal angular displacements of shafts 55 and 46 are unequal, while also the transmission ratio varies. For instance it can be easily seen in FIG. 3 that rotation of the lever 56 in the positions situated adjacent the final position drawn in FIG. 3, only slightly changes the angular position of the shaft 46. Also the transmission ratio between shafts 55 and 65 is variable through the employed coupling by means of levers 61 and 64.

The above described coupling means are chosen for tuning the gas passages at each heating capacity set under control of the above modulating regulator and the admission of secondary air in such a way that a maximal output is obtained with the utilized gas.

Other embodiments of the control for the admission of secondary air are possible. However, the above described embodiment has the advantage of being realized underneath the boiler installation at the cost of only a slight increase in building height, and in combination with a perfect control.

I claim:

1. A gas-fired boiler installation with control of supply of combustion components comprising, in combination: a boiler flue; combustion space that upwardly is in communication with said boiler flue, the bottom side of said combustion space being confined by a burner bed having atmospheric burners horizontally positioned with interposed venturi tubes, which upon throughflow by the gas controllably supplied via a single valve, draw in primary air, and wherein, between the elements of the burner bed, from the bottom side thereof, secondary air can be drawn into the combustion space; and control means for variably controlling supply of secondary air in conjunction with variably controlling gas supply control, said control means for controlling supply of secondary air in conjunction with gas supply control including control adjustment means for said gas valve through which the gas is supplied, control adjustment means for a control valve for the secondary air and a driving unit, each of said control adjustment means being connected to said driving unit; whereby excess of air upon loads smaller than those at maximal capacity and their cooling affects are avoided.

2. An installation according to claim 1, wherein admission passage for the primary air in the burner bars and admission passage for the secondary air flowing along the exterior of the burner bars are entirely separated passages.

3. An installation according to claim 1 or 2, wherein said control adjustment means for a control valve for the secondary air comprises a control valve which is adapted for shutting off and releasing the bottom side of the space accomodating the gas burner bed.

4. An installation according to claim 3, wherein the control valve is a substantially horizontal valve movable up and down.

5. An installation according to claim 1 including two shafts, adjustment of said control valve and of said gas valve being responsive to the position of said two shafts which are coupled to said driving unit, the one operating said gas valve and the other the said control valve for the secondary air.

6. An installation according to claim 1, including means for varying the ratio between the transmission ratio of said driving unit to said gas valve relative to the transmission ratio of said driving unit to said control valve for the secondary air.

7. An installation according to claim 1, including means for varying the transmission ratio of said driving unit to at least one of said gas valve and said control valve for secondary air.

8. An installation according to claim 7, wherein said means for varying comprise at least one lever and rod assembly for driving said control valve.

* * * * *